US010709178B2

(12) United States Patent
Alaniz, III

(10) Patent No.: US 10,709,178 B2
(45) **Date of Patent: *Jul. 14, 2020**

(54) ELASTIC DEVICE

(71) Applicant: Pedro M. Alaniz, III, Corpus Christi, TX (US)

(72) Inventor: Pedro M. Alaniz, III, Corpus Christi, TX (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/984,395

(22) Filed: May 20, 2018

(65) Prior Publication Data

US 2018/0263303 A1 Sep. 20, 2018

Related U.S. Application Data

(63) Continuation-in-part of application No. 15/434,006, filed on Feb. 15, 2017, now Pat. No. 10,363,452.
(Continued)

(51) Int. Cl.
*A41D 13/00* (2006.01)
*A41B 1/00* (2006.01)
(Continued)

(52) U.S. Cl.
CPC ..... *A41D 13/0015* (2013.01); *A41B 1/00* (2013.01); *A63B 21/0552* (2013.01);
(Continued)

(58) Field of Classification Search
CPC ..... A63B 21/0004; A63B 21/00043; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/078; A63B 21/0783; A63B 21/4001; A63B 21/4007; A63B 21/4017; A63B 21/4023; A63B 21/4025; A63B 21/4027; A63B 21/4039; A63B 21/4043; A63B 23/035; A63B 23/03516; A63B 23/12; A63B 23/1209; A63B 23/1227; A63B 23/1236; A63B 23/1245; A63B 23/1254; A63B 23/1281; A63B 69/0057; A63B 69/0059;
(Continued)

(56) References Cited

U.S. PATENT DOCUMENTS 1,656,145 A 1/1928 Davis
2,456,190 A 12/1948 Heilbronner
(Continued)

FOREIGN PATENT DOCUMENTS

WO WO2014/131446 9/2014

*Primary Examiner* — Gary D Urbiel Goldner
(74) *Attorney, Agent, or Firm* — G. Turner Moller

(57) ABSTRACT

An arm and chest exerciser includes elastic cuffs into which a user places the upper arms. An elastic chest band connects the cuffs. Moving the user's arms backwardly stretches the chest band and exercises muscles of the arms, chest and shoulder. A gripping handle connects to the chest band adjacent to a midpoint allowing the user or spotter to pull down on the chest band and appropriately position it on the user's chest.

9 Claims, 2 Drawing Sheets

Related U.S. Application Data

(60) Provisional application No. 62/603,203, filed on May 22, 2017.

(51) Int. Cl.
*A63B 71/12* (2006.01)
*A63B 21/055* (2006.01)
*A63B 21/00* (2006.01)
*A63B 21/078* (2006.01)

(52) U.S. Cl.
CPC ..... *A63B 21/4025* (2015.10); *A63B 71/1291* (2013.01); *A41D 2400/44* (2013.01); *A41D 2600/10* (2013.01); *A63B 21/078* (2013.01); *A63B 21/0783* (2015.10); *A63B 2244/09* (2013.01)

(58) Field of Classification Search
CPC ..... A63B 71/0054; A63B 2071/0063; A63B 2071/0072; A63B 2244/09
See application file for complete search history.

(56) References Cited

U.S. PATENT DOCUMENTS 2,949,915 A * 8/1960 Lilyan ..... A41C 3/00 450/8
3,056,401 A * 10/1962 Greenspan ..... A61B 5/021 600/494
3,529,820 A * 9/1970 Templeton ..... A63B 21/0552 482/122
4,273,328 A 6/1981 Ozbey
4,473,908 A 10/1984 Knecht
4,540,173 A * 9/1985 Hopkins, Jr. ..... A63B 21/0552 482/124
4,570,929 A 2/1986 Shoemaker
4,800,593 A 1/1989 Ruffner
4,852,874 A * 8/1989 Sleichter, III ..... A63B 21/0004 482/122
4,993,705 A * 2/1991 Tolle ..... A63B 21/00185 482/124
5,167,601 A 12/1992 Frappier
5,308,305 A * 5/1994 Romney ..... A63B 21/4025 2/69
5,383,235 A 1/1995 Peters
5,573,487 A 11/1996 Wallner
5,659,898 A * 8/1997 Bell, Jr. ..... A41D 13/0015 2/115
5,803,881 A 9/1998 Miller
5,915,531 A 6/1999 Hilpert
5,957,878 A * 9/1999 Gilliam ..... A41D 13/0015 128/856
6,061,832 A 5/2000 Morrison
6,203,453 B1 3/2001 Coddens
6,231,488 B1 * 5/2001 Dicker ..... A41D 13/0015 2/69
6,244,998 B1 * 6/2001 Hinds ..... A63B 21/0004 482/124
6,458,036 B1 * 10/2002 Gutierrez ..... A63B 69/0059 473/207
7,699,761 B1 4/2010 Dieter
7,707,652 B2 5/2010 Senegal
8,578,517 B2 * 11/2013 Alaniz ..... A41D 13/0015 2/115
8,771,155 B1 7/2014 Bell
D748,209 S 1/2016 Alaniz
9,265,983 B1 2/2016 Bell
9,333,385 B2 * 5/2016 Hinds ..... A63B 21/02
9,427,622 B2 * 8/2016 Thrasher-Rudd ..... A63B 21/00061
9,707,433 B1 * 7/2017 McGibbons ..... A63B 21/0557
9,895,569 B2 * 2/2018 Yao ..... A63B 69/0028
10,363,452 B2 * 7/2019 Alaniz, III ..... A63B 21/0552
10,486,008 B2 * 11/2019 Prihar ..... A63B 23/12
2002/0160891 A1 * 10/2002 Gallagher ..... A63B 21/04 482/123
2007/0000015 A1 1/2007 Alaniz
2008/0214330 A1 9/2008 Goebel
2010/0218300 A1 * 9/2010 Alaniz ..... A41D 13/0015 2/115
2013/0298301 A1 * 11/2013 Petrakis ..... A63B 21/065 2/69
2014/0073496 A1 * 3/2014 Bannerman ..... A63B 21/0552 482/139
2014/0171275 A1 * 6/2014 Tatum ..... A63B 21/0004 482/124
2014/0317826 A1 * 10/2014 Decker ..... A41B 1/08 2/69
2014/0352026 A1 * 12/2014 Ruth Ann ..... A41D 27/02 2/69
2015/0189927 A1 * 7/2015 Bunting ..... A41D 13/015 2/456
2016/0183606 A1 * 6/2016 Shriver ..... A63B 21/0552 2/69
2017/0106228 A1 * 4/2017 Belveal ..... A63B 21/4007
2017/0225024 A1 * 8/2017 Thrasher-Rudd ..... A63B 21/0552
2017/0231798 A1 * 8/2017 Shin ..... A61F 5/02 2/44
2017/0232290 A1 * 8/2017 Alaniz, III ..... A41D 13/0015 482/124
2018/0035727 A1 * 2/2018 Cumiskey ..... A41D 13/0015
2019/0275370 A1 * 9/2019 Alaniz, III ..... A41D 13/0015

* cited by examiner

ELASTIC DEVICE

This application is a continuation-in-part of application Ser. No. 15/434,006, filed Feb. 15, 2018, now U.S. Pat. No. 10,363,452, issued Jul. 30, 2019, and claims priority of Provisional Application 62/603,203 filed May 22, 2017, the disclosures of which are incorporated herein by reference.

This invention relates to an improved elastic device spanning the chest of a user to exercise the chest and arms of a user or which may be used for increasing the lift capacity of the user.

BACKGROUND OF THE INVENTION

There are a number of chest and arm exercising devices that incorporate cuffs receiving the arms of a user and an elastic band connecting the cuffs and extending across the chest. These devices are used when doing push ups, lifting weights in a bench press exercise, overhead presses, incline and decline presses and triceps dips. Typical devices are shown in U.S. Pat. Nos. D748,209, 4,273,328, 4,570,929, 5,573,487, 8,777,155, and 9,265,983 and U.S. Printed Patent Application 2008/0214330, the disclosures of which are incorporated herein by reference. It is this type device to which the disclosed elastic member most nearly relates. Other U.S. Patents of some interest are U.S. Pat. Nos. 2,808,267; 3,324,851; 4,799,675; 4,890,841 and 6,616,581.

Weight lifting is a sport, like all sports, where small differences in performance are the difference between winning and losing, especially in top flight competition. The reason, of course, is that competitors are normally very evenly matched.

SUMMARY OF THE INVENTION

A device is disclosed having an elastic chest band and aria cuffs which may foe used as an arm and chest exerciser. The device may also be used to increase the lifting capacity of a user in an event where such is allowed. The chest band may include a rubber or rubber-like sheet which may be encased or partially encased in fabric. The rubber or rubber-like sheet provides desirable elastic characteristics in the exercise device while the fabric provides reduced frictional contact between the elastic sheet and the user's body. A gripping device or tab is secured adjacent a center of one or several edges of the chest band to allow a user or spotter to adjust the position of the exercise device on the user's chest. This invention comprises an improved gripping device that accommodates elastic movement of the chest band. The improved gripping device may comprise an elastic section secured to the elastic chest band and an inelastic handle fixed to the elastic section but only indirectly connected to the chest band, i.e. through the elastic section of the gripping device.

In one embodiment, the improved gripping device includes an elastic member having opposite ends secured to the chest band and an inelastic member secured to the elastic member. In some embodiments, the elastic member may comprise a tube and the inelastic member is inside the tube. The inelastic member may be secured to the elastic member at opposite ends of the inelastic member at a location away from the chest band and the inelastic member is secured to the elastic chest band only through the tube in which it is located.

DETAILED DESCRIPTION OF THE INVENTION

Figure 1:
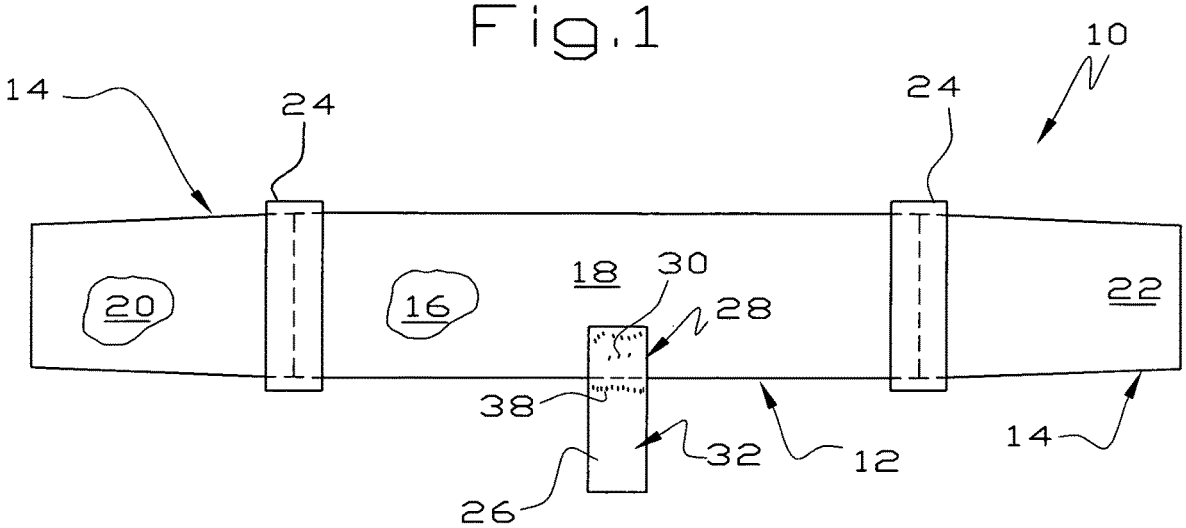
FIG. 1 is a front view of one embodiment of an exercise device, part of a fabric sleeve being cut away to show an elastic rubber sheet.
Figure 2:
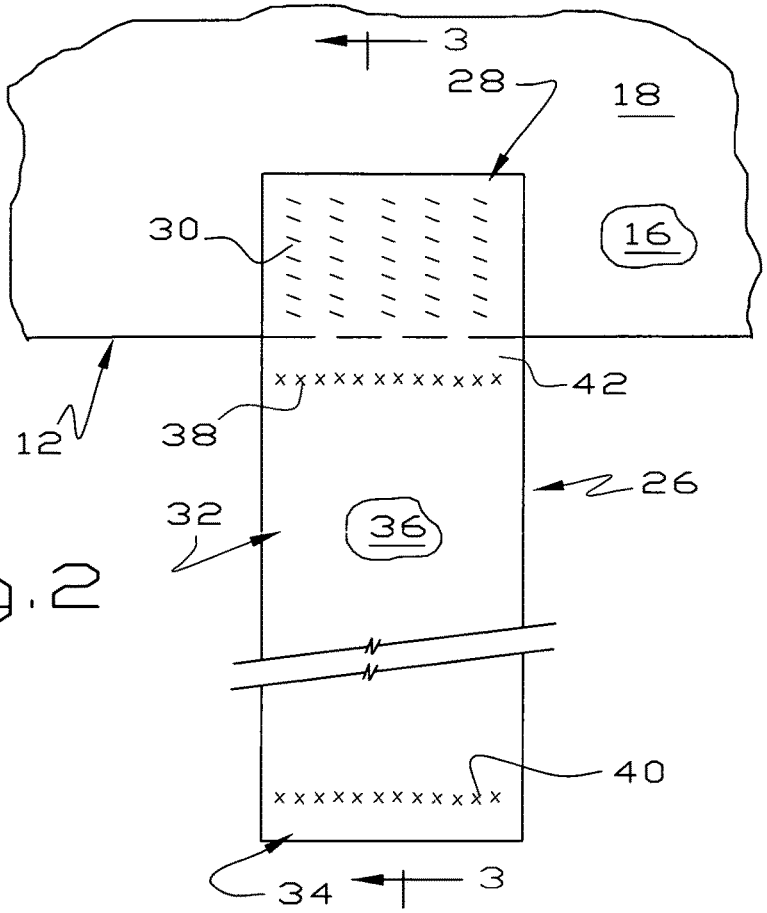
FIG. 2 is an enlarged view of the gripping device shown in FIG. 1, part of the outer tube being broken away to show an inner inelastic member.
Figure 3:
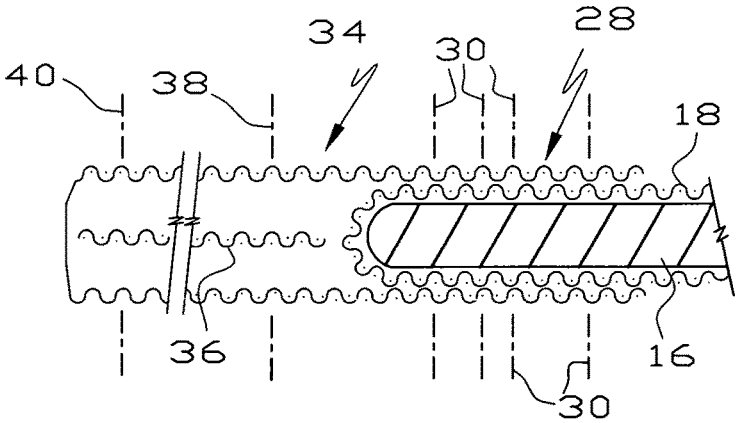
FIG. 3 is a cross-sectional view of the gripping member of FIGS. 1-2, taken substantially along line 3-3 as viewed in the direction indicated by the arrows.

Referring to FIGS. 1-3, an elastic device 10 comprises an elastic member or chest band 12 connected to left and right arm cuffs 14. In some embodiments, the elastic band 12 may be a simple elastic fabric or may preferably be a composite structure including a rubber or rubber-like sheet 16 encased in a sleeve 18. The rubber sheet 16 may preferably be elastic in both the long dimension between the cuffs 14 and the short dimension perpendicular to the long dimension.

The material of the rubber sheet 16 may be a natural or synthetic rubber of any suitable type. As used herein, rubber is a generic term meaning rubber, latex, organic polymer and the like which exhibit the characteristics of rubber. One suitable type is currently commercially available from The Hygenic Corp, of Akron, Ohio. Such latex or rubber sheets are typically impermeable having a slick exterior which is particularly suited to receive graphics which may be printed, silk screened or otherwise applied onto the exterior. As used herein, impermeable means that the material is not permeable even though the object may have inconsequential openings formed therein. The elasticity or resistance of the rubber sheet may vary considerably depending on the physical strength of the intended user. Exercise devices for women and children may be considerably more elastic or have considerably less resistance than for adult men and there may be considerable variation in the resistance for adult men depending on the degree of physical strength of the intended user. As used herein, the word sheet describes an object that has width, length and thickness where the width or length is at least ten times thickness and may preferably be twenty times thickness and ideally may be even larger, for example thirty times thickness.

The resistance of the elastic member 12 depends in part on the width of the sheet 16, the length of the sheet 16, the thickness of the sheet 16 and the strength of the material used. Appropriate selection of thickness, material characteristics, width and length cooperate to produce an exercise device having a desired resistance to stretching of the chest band 12. One suitable combination of thickness, length and width is a 15 centimeter or 5.9 inch width, a thickness of 4.5 millimeters or 0.177 inches and a length in proportion to the size of the user with the commercially available material. One combination of thickness, width and material produces a rubber sheet 15 having an elongation of about 20% at eighty pounds of tension and an elongation of about 50% at one hundred forty pounds of tension, both in a longitudinal direction between the arm cuffs 14 and in a direction perpendicular to the longitudinal direction.

In another embodiment, a suitable rubber sheet of 15 centimeter width, 4.5 millimeter thickness and 24 centimeter length exhibited a stretch of approximately 3" or 7.62 centimeters which is about 32% of the starting length.

It is apparent there may be a considerable variation in the resistance of the elastic member 12. A typical range of resistances, providing for adult men of different capacity, women of different capacity and children of different capacity would be about 25% elongation at 50-150 pounds tension and 50% elongation at 100-175 pounds tension.

It will be apparent that considerable variation may occur in thickness, width and material to provide the desired resistance to movement of the arm cuffs 14. In general, the thickness of the rubber sheet 16 may be between about one tenth to about three-eights inch thick to provide a substantial resistance to spreading of the arm cuffs 14 away from each other. The width of the rubber sheet may vary from about two inches to about ten inches, most of the width variation being in response to the variation in size of the user. The length of the rubber sheet 16 depends on the size of the individual for whom the exercise device 10 is made and may vary from about 4" (10 centimeters) to about 13" (33 centimeters).

The rubber sheet 16 may have surface characteristics that make it undesirable for contact with the chest or arms of a user in the sense that the sheet 16 may frictionally grab the user even though the user may be wearing a shirt. The friction generated by movement against clothing is unpredictable due to the wide variety of commercial shirts worn by lifters, athletes and general fitness lifters. Elasticity and friction properties of shirts can vary widely due to the varying contents of natural and synthetic fibers as well as pattern designs or ink in available commercial brands. When using heavy or maximum weights, smooth efficient form or technique is critical. Any inconsistency or jerky movements can lead to loss of form or technique that can lead to failure of the lift or potential injury. The disclosed construction assures that the device works efficiently regardless of what the user is wearing, either in the way of a shirt or bare-chested.

The sleeve 18 may be of any suitable material having the characteristic of not frictionally grabbing the rubber sheet 16 and typically may be a fabric made of natural fibers, synthetic fibers or a mixture of natural and synthetic fibers and which is sufficiently elastic to accommodate stretching of the rubber sheet 16. The sheet 16 may be encased in the sleeve 18 and secured thereto in any suitable manner, as by conventional lines of stitching (not shown) or the like. In some embodiments, a fabric sheet (not shown) may cover only the body side of the rubber sheet (not shown). In other embodiments, the rubber sheet 16 may be free of any abutting fabric.

The arm cuffs 14 may be an elastic fabric material, as in the prior art, or may be a composite structure similar to the band 12 and thereby include a rubber or rubber like sheet 20 curled into a more-or-less circular shape and encased in a sleeve 22. The sheet 20 may preferably be sewn to the sleeve 22 by one or more lines of stitching or in any other suitable manner. The sheet 20 may be the same material as the sheet 16.

The central or chest band 12 may be connected to the arm cuffs 14 in any suitable manner. In some embodiments where the sheets 16, 20 are thin enough to be overlapped and sewn together, the sheet ends may be overlapped and sewn to each other. In situations where the sheets 16, 20 are thicker, ends of the rubber sheets 16, 20 preferably abut, rather than overlap, and are connected together in a suitable manner as by gussets 24 sewn to abutting ends of the sheets 16, 20. The gussets 24 may comprise a fabric of considerably more strength than the fabric of the sleeves 18, 22. This positions the chest band 12 on a periphery or circumference of the arm cuff 14 which is a desirable location.

A bodily flexible gripping member, handle or loop 26 may be sewn to one or both edges of the rubber sheet 16 near a midpoint of the chest band 12. This allows a spotter to pull on the handle 26 and thereby adjust the location of the elastic member 12 on the user's chest while the user is exercising. The handle 26 is accordingly transverse or preferably perpendicular to the long dimension of the chest band 12. FIG. 1 shows the gripping member 26 may be on a lower edge of the exercise device 10, i.e. on an edge of the chest band 12 away from the user's head. The gripping member 26 has unusual characteristics because part of it is elastic and part of it is inelastic. The member 26 accordingly may include an elastic section or patch 28 sewn by stitching 30 or otherwise secured to the chest band 12 and an inelastic section 32 which is gripped by a user or spotter.

As shown in FIGS. 2 and 3, the member 26 may include an elastic tube 34 of a suitable flexible material, such as SPANDEX, a commercially available elastic fabric, or other suitable elastic fabric or non-fabric material, having one end, or both ends, sewn by stitching 30 to the sleeve 18 and the rubber sheet 16. An inelastic member or strap 36, inside the tube 34, may be secured solely to the tube 34, as by one or more rows of stitching 38 or the like thereby indirectly connecting the inelastic strap 36 to the chest band 12. This may be accomplished by positioning the stitching 38, 40 outside of the dimensions of the chest band 12. The inelastic strap 36 may be of any suitable type such as an inelastic plastic film, a suitable fabric such as nylon or any other inelastic material that is readily secured to the elastic tube 34.

This renders the section 32 of the gripping member 26 inelastic while the elastic section 28 secured to the chest band 12 remains elastic. This allows the chest band 12 to elastically deform without being constrained by an inelastic member attached to it, as in the device shown in application Ser. No. 15/434,006. Making the section 28 elastic prevents the chest band 12 from being damaged by pulling on the gripping handle 26 while the chest band 12 is being elastically deformed. Making the gripping handle wholly elastic is not desirable because applying tension to am elastic handle causes a great deal of extension of the handle and little movement of the chest band.

If desired, another band of stitching 40 near the end of the gripping device 26 may connect the elastic tube 34 and the inelastic member 36. In one sense, the gripping member 26 includes an elastic patch 28 secured to the chest band 12, an elastic section 42 integral with the patch 28 and an inelastic section 32 secured to the section 42. The inelasticity of the gripping member 26 depends on the distance between the stitching 30, 38, i.e. the length of the section 42 perpendicular to the long dimension of the chest band 12. If the section 42 is very long, the gripping member 26 becomes somewhat elastic. If the section 42 is very short, the gripping member 26 is almost completely inelastic. A preferred length of the section 42 makes the gripping member 26 inelastic which is defined to include substantially inelastic. This length is usually in the range of ¼ inch to three inches.

Figure 4:
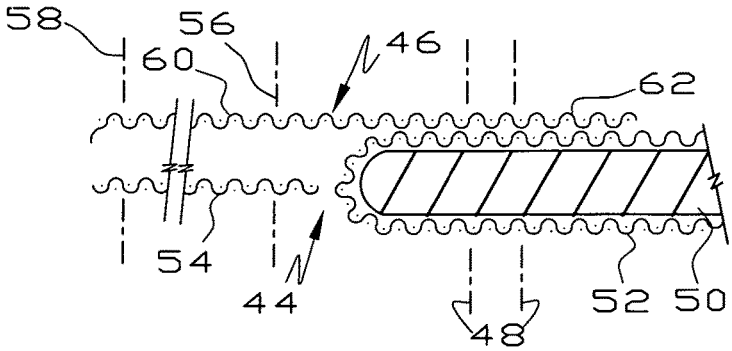
FIG. 4 is a cross-sectional view, similar to FIG. 3, of another embodiment of a gripping device.

As shown in FIG. 4, a gripping handle 44 may include an elastic strap 46, rather than a tube, having one end connected, as by stitching 48 or the like to a chest band 50 which may or may not include a fabric sleeve 52. An inelastic strap 54 may be secured to the elastic strap 46 by stitching 56, 58 or other suitable means and thus indirectly connected, rather than directly connected, to the chest band 50. This may be accomplished by stitching the strap 54 solely to the strap 46 outside of the dimensions of the chest band 50 or in any other suitable manner. In this manner, part 60 of the elastic strap 46 is rendered inelastic while an elastic section 62 is directly secured to the chest band 50. It will be apparent to those skilled in the art that other designs of a partly elastic, partly inelastic pull strap may be devised.

Figure 5:
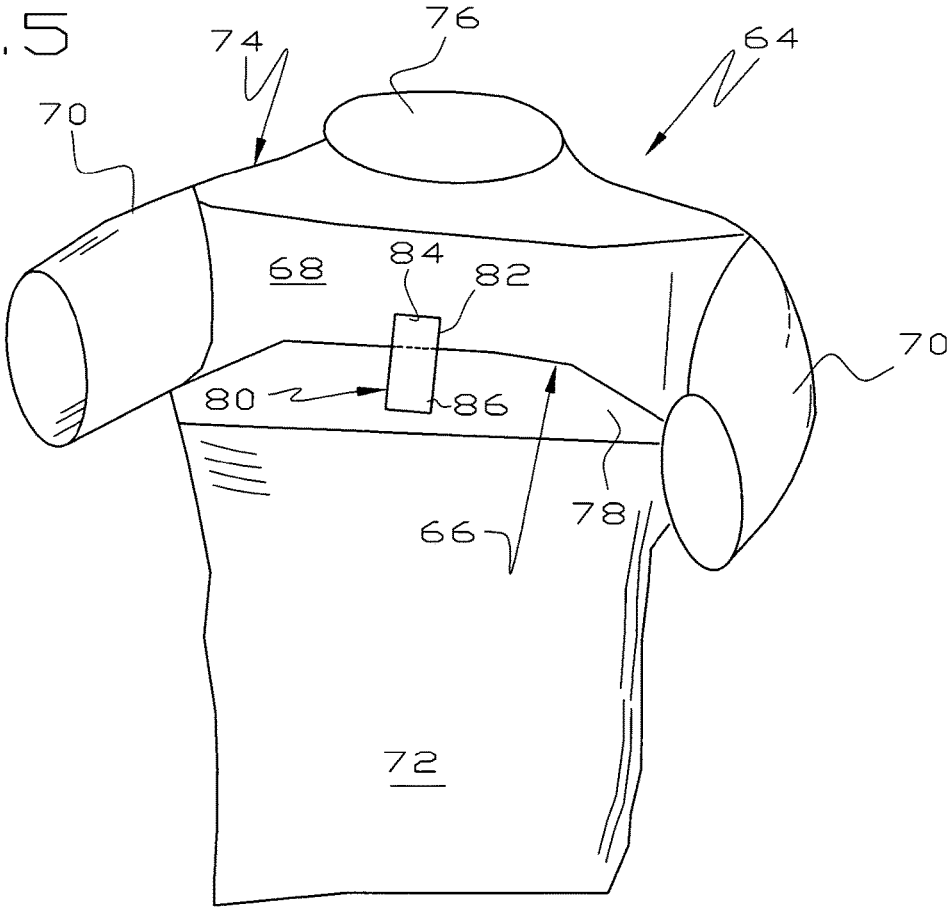
FIG. 5 is a pictorial view of a shirt incorporating a gripping member of the type shown in FIG. 4.

Referring to FIG. 5, a lifter's garment or shirt 64 is made of different materials, a relatively weak fabric providing most of the shirt 64 and an elastic device 66 comprising a relatively strong elastic member 68 extending across the chest of the user and strong elastic arm cuffs 70 which act to increase the user's lifting capacity. Although the garment 64 may be made of any suitable material, the preferred weak fabric may be made of a heavyweight polymeric yarn that is fairly stable with a slight to minimal stretch. Its properties include high modulus (power) characteristics, the ability to absorb more stress them fabrics made of natural fibers, the ability to better retain or return to its original shape than fabrics made from natural fibers, and the ability to expand or stretch before rupturing in a manner similar to taffy stretching before it breaks, unlike fabrics made from natural fibers which generally fail sooner and simply rupture.

The weak fabric may be wholly elastic or partly elastic and partly inelastic. The elastic fabrics stretch at least in a circumferential direction around the user's body and meaning they are not inelastic, by which is meant the material stretches less than 1-3% when pulled to the maximum ability by an adult male non-lifter, i.e. about 100 pounds, parallel to the weave and distorts when pulled on the bias but stretches less than 1-3%. The weak elastic fabric may be elastic in perpendicular directions but may preferably be elastic only in the circumferential direction around the user's body.

The shirt 64 includes a torso encircling section 72 including a front and a back and a shoulder assembly 74 including a head or neck hole 76 secured, as by stitching or the like, to the elastic device 66.

The back of the shirt 64 may be continuous, i.e. in the manner of a pull over shirt, may have openings therein or may be openable and include suitable straps, buttons, zippers or other means of securing back sections together. Lifter's shirts incorporating fabrics similar to the weak fabric material and inelastic fabrics are known in the prior art and are available from Titan Support Systems, Inc. of Corpus Christi, Tex. The shirt 64 is sized to be fairly tight on the wearer, typically about as tight as currently used lifting shirts.

The parts of the shirt 64 made of a fabric that may not store energy include the torso encircling section 72 and the shoulder assembly 74. The upper front torso encircling section 72 may terminate below the elastic device 66 so the shoulder assembly 74 is accordingly spaced from the torso encircling section 72 by a gap which is closed or spanned by the chest band 68 extending across the front of the shirt 64 and across the lifter's chest.

The elastic sleeves or cuffs 70 may be at a forward angle in a manner similar to modern weight lifting shirts and as shown in U.S. Pat. No. 4,473,908. The sleeves 70 may extend at any desirable angle.

The material of the strong elastic part of the shirt 64, i.e. the band 68 and sleeves 70, may be a fabric, a non-woven sheet, a rubber sheet or any other suitable elastic material. A suitable elastic fabric material is a heavy woven fabric comprising natural rubber yards and synthetic polymer yarns, such as polyester or nylon, for added strength. A recommended count of rubber yarn assemblies is in the range of 25-60 wrapped yarn assemblies per three inch width. Each wrapped yarn assembly may comprise four smaller rubber yarns for a total rubber yarn count in the range of 100-240 rubber yarns per three inch width. A preferred count of rubber yarn assemblies may be 40 wrapped yarn assemblies each comprising four smaller rubber yarns for a preferred count of 160 rubber yarns. The weight of a preferred elastic material may be 121 grams per yard or 4.27 ounces/yard. This compares to a common brand of three inch wide elastic material found in most fabric stores of 41 grams per yard or 1.44 ounces/yard. A preferred elastic material is available from North East Knitting, Inc. of Pawtucket, R.I. to which reference is made for a more complete description of the elastic fabric material. A suitable rubber sheet material is described above. The material of the chest band 68 and cuffs 70 is preferably at least three times stronger than the material of the torso encircling section 72 and the shoulder assembly 74 and may ideally be greater, i.e. in the range of five to ten times stronger.

The sleeves 70 are accordingly sewn or otherwise affixed to the band 68 in the same manner that the cuffs 14 are connected to the elastic member 12 so that movement of a weight lifter's arms to the rear, or downwardly, in a bench press movement, moves the sleeves 70 and thereby stretches the band 68.

The shoulder assembly 74 is affixed to the upper edge of the elastic band 68 in any suitable manner, by sewing or the like. The lower front is affixed to the lower edge of the elastic band 68, also by sewing or any other suitable technique. The torso encircling section 72 and the shoulder assembly 74 may comprise panels that are joined by sewn seams or other suitable technique. It will be seen that the elastic and inelastic parts of the shirt 64 contribute to making a torso section and sleeves of a somewhat conventional looking shirt.

In some embodiments, the material of the torso encircling section 72 and shoulder assembly 74 may include elastic panels 78 of intermediate strength to provide a transition between the heavy duty elastic material of the band 66 and sleeves 68 and the torso encircling section 70. Similar panels (not shown) may be provided between the upper end of the chest band 66 and the shoulder assembly 72. Such materials are available commercially from Gehring Textiles, Inc. of Garden City, N.Y.

The elastic band 68 and sleeves 70 are joined, as by sewing, so that movement of the lifter's arms toward the rear causes the sleeves 70 to move and stretch the band 68 thereby storing energy in the band 68. Conversely, movement of the lifter's arms toward the front allows the band 68 to assist in forward movement of the lifter's arms. It will be seen that the band 68 and sleeves 70 are similar to the exercise device shown in FIGS. 1-8 and U.S. Design Pat. No. 748,209. Thus, in a way, an exercise device has been incorporated into the a shirt so that movement of a lifter's arms alternately stores energy in the band 68 when a weight is lowered and then expends energy when the weight is raised.

In a bench press exercise, a lifter on his back grasps a bar and raises it off a stand and lowers the bar until it is level with his chest. This moves the lifter's arms downwardly and rearwardly, distorts the sleeves 70 and lengthens the elastic band 68 thereby storing energy in the band 68. When the lifter raises the bar, energy stored in the band 68 assists in lifting the bar and thereby adding to the lifter's efforts. This allows the lifter to lift a greater weight than he could do without the elastic elements of the shirt 64.

A gripping handle 80 may be sewn to an edge of the chest band 68 to allow a spotter to adjust the location of the chest band 68 on the user's chest. The handle 80 may be on a lower edge of the chest band 68 away from the user's head. The gripping handle 80 has unusual characteristics because part of it is elastic and part of it is inelastic. The handle 80 accordingly may include an elastic section 82 sewn by stitching 84 or otherwise secured to the chest band 68 and an inelastic section 86 which is gripped by a user or spotter.

The bodily flexible handle 80 may be of any suitable type and may be similar to the embodiments of either FIG. 3 or 4, and may include an elastic strap rather than a tube, having one end, sewn or otherwise secured to the chest band 68 which may or may not include a fabric sleeve. An inelastic strap may be secured solely to the elastic strap so the inelastic strap is indirectly, rather than directly, connected to the chest band 68. This may be accomplished by placing the stitching outside of the dimensions of the chest band or other suitable means.

In this manner, part of the elastic strap is rendered non-elastic while an elastic section 82 is directly secured to the chest band 68. This allows the chest band 68 to elastically deform without being constrained by an inelastic member attached to it, as in the device shown in application Ser. No. 15/434,006. Making the section 80 elastic prevents the chest band 68 from being damaged by pulling on the gripping handle 80 while the chest band 68 is being elastically deformed.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention.

I claim:

1. An arm and chest elastic device comprising:

first and second arm cuffs configured to encircle an upper portion of a user's left and right arms;

a chest band comprising a central elastic member of generally rectangular shape with a long dimension and a short dimension, the first and second arm cuffs being attached to opposite ends of the central elastic member, the central elastic member being configured to extend across a chest of the user; and a gripping handle of generally rectangular shape attached to the central elastic member adjacent to a midpoint thereof and extending perpendicularly away from the long dimension of the central elastic member;

the gripping handle being configured to be pulled by a third party during stretching of the chest band and thereby adjust the position of the chest band on the chest of the user.

2. The arm and chest elastic device of claim 1 wherein the gripping handle includes an elastic section secured to the chest band and an inelastic section extending away from the chest band.

3. The arm and chest elastic device of claim 2 wherein the central elastic member comprises a rubber sheet having a width, a length and a thickness wherein the width and length are at least ten times the thickness.

4. The arm and chest elastic device of claim 3 further comprising a fabric sleeve encasing the central elastic member.

5. The arm and chest elastic device of claim 1 wherein the gripping handle comprises an elastic section fixed to the central elastic member and an inelastic member fixed solely to the elastic section thereby connecting the inelastic member to the chest band member through the elastic section.

6. The arm and chest elastic device of claim 5 wherein the elastic section of the gripping handle comprises a tube and the inelastic member is located inside the tube.

7. The arm and chest elastic device of claim 5 wherein the elastic section of the gripping handle comprises a strap and the inelastic member is fixed to the strap rendering part of the elastic section of the gripping handle inelastic.

8. The arm and chest elastic device of claim 1 wherein the central elastic member is expansible in a first direction between the first and second arm cuffs and expansible in a second direction perpendicular to the first direction, expansibility of the central elastic member in the first direction being substantially equal to expansibility of the central elastic member in the second direction.

9. The arm and chest elastic device of claim 1 wherein the central elastic member comprises a rubber sheet.

* * * * *